United States Patent [19]

Rump

[11] 4,281,598

[45] Aug. 4, 1981

[54] WIDE WIDTH PRINTING PROCESS

[75] Inventor: Björn S. Rump, Vandoeuvres, Switzerland

[73] Assignee: Sublistatic Holding S.A., Glaris, Switzerland

[21] Appl. No.: 947,292

[22] Filed: Sep. 29, 1978

[30] Foreign Application Priority Data

Oct. 7, 1977 [CH] Switzerland ..... 12273/77

[51] Int. Cl.[3] ..... D06P 7/00; D06Q 1/00; B41F 13/02

[52] U.S. Cl. ..... 101/470; 8/471; 101/228; 428/914

[58] Field of Search ..... 101/470, 219, 228; 428/914; 8/2.5 A

[56] References Cited

U.S. PATENT DOCUMENTS

| | | | |
|---|---|---|---|
| 1,147,920 | 7/1915 | Bechman | 101/219 |
| 1,431,454 | 10/1922 | Bechman | 101/219 |
| 3,275,465 | 9/1966 | Rathke | 428/914 |
| 3,915,628 | 10/1975 | Bossard | 101/470 |
| 3,924,532 | 12/1975 | Hubbard | 101/219 |
| 3,992,988 | 11/1976 | Dwyer | 101/407 |
| 3,994,250 | 11/1976 | Norris | 101/470 |
| 4,008,661 | 2/1977 | Mathis | 101/219 |
| 4,089,722 | 5/1978 | Holoubek | 428/914 |

FOREIGN PATENT DOCUMENTS

| | | | |
|---|---|---|---|
| 2390294 | 12/1978 | France | 101/470 |
| 1032813 | 6/1966 | United Kingdom | 428/914 |
| 1338475 | 11/1973 | United Kingdom | 101/470 |
| 1343927 | 1/1974 | United Kingdom | 101/470 |

*Primary Examiner*—Clyde I. Coughenour

[57] ABSTRACT

Plural donor design transfer strips that undergo linear change with temperature change are used simultaneously to print on one wide width receptor web. The donor strips are preheated, then alined and adjusted using register marks thereon, then introduced together with the receptor web into the heat transfer machine for transfer of the designs to the receptor web so that the design edges coincide on the web.

8 Claims, 1 Drawing Figure

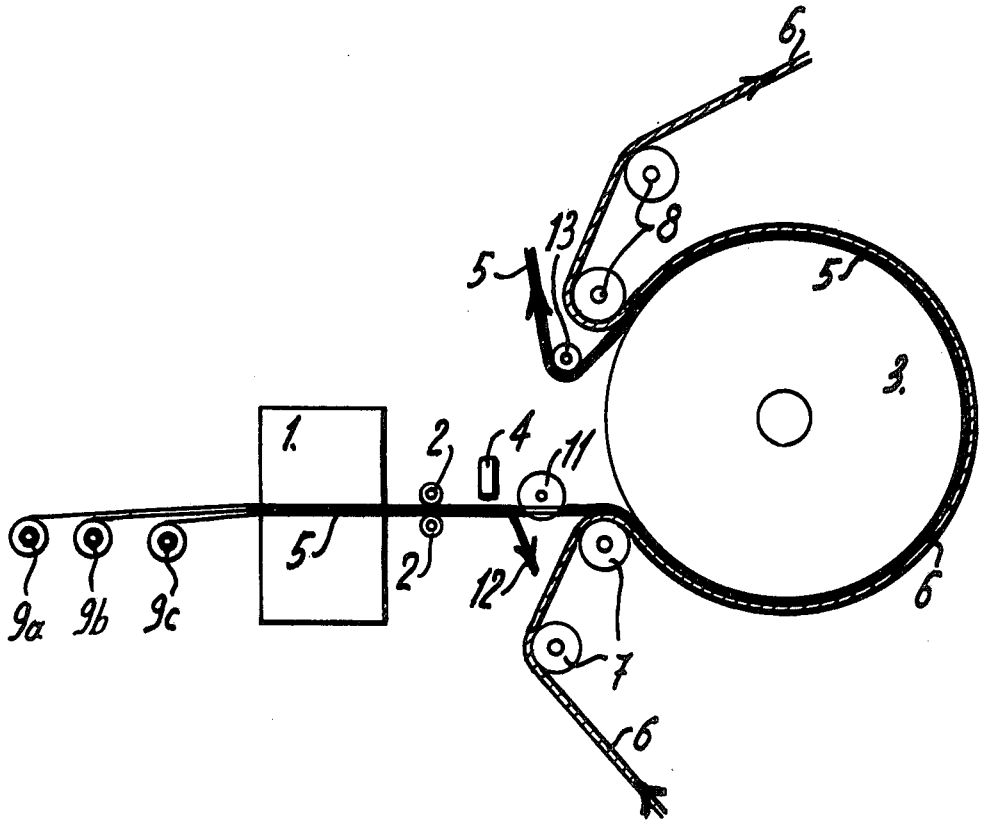
6
13
8
5
5
3
1
2
4
11
5
2
12
6
9a
9b
9c
7
6

WIDE WIDTH PRINTING PROCESS

The present invention relates to wide width transfer printing. In conventional processes, the surface to be printed is brought into contact with an auxiliary carrier which carries the print to be transferred, and the width of which is at least equal to that of this surface. The present invention relates to a process for transfer printing webs of material of wide width (that is to say greater than 1.60 m), which does not require an auxiliary carrier to wide width. It allows the use of auxiliary carriers of standard width (for example 1.60 m or less), which are juxtaposed to form a web of wide width, without faults such as a white line or a staggering of the design appearing in the areas where the auxiliary carriers are juxtaposed.

It is known to transfer-print webs of material of wide width by using carriers of lesser width, carrying dyestuffs which are transferable in the vapour phase when hot (Swiss Application No. 8,975/77). According to this known process, these carriers are placed edge to edge or overlapping and are so arranged longitudinally as to cause the pattern to coincide on either side of the joints. These joints are parallel to the edges of the wide width web thus formed. Thereafter, this wide width web is introduced into a calender where it is heated in contact with a substrate onto which the pattern is transferred.

These auxiliary carriers which carry the transferable print are generally made of paper. Depending on the quality of the paper, certain disadvantages may manifest themselves during transfer. In particular, an opening-up of the joint as well as a longitudinal staggering is observed, due especially to a different behaviour of one paper carrier from another. This longitudinal staggering may reach 2 mm or more and the webs may move apart, in the area of the joint, by 1.5 to 4 mm.

Furthermore, these faults vary along the joints in an unforseeable manner and in many cases cannot be compensated beforehand when producing the wide-width web.

The present invention overcomes these disadvantages. It relates to a transfer printing process in which (a) at least two strips of paper provided with transferable designs or patterns are brought edge to edge, (b) the relative positions of these webs are adjusted by means of a register mark so that the designs or patterns coincide on either side of the joint or joints parallel to their edges, (c) the wide width web thus made up by assembling is introduced into a transfer machine where it is brought into contact with the substrate to be printed and (d) the whole is heated at between 160° and 250° for sufficient time to effect the transfer, characterized in that the webs of transfer paper which have already been printed are preheated to between 90° and 150° C. before bringing them into register for the purpose of adjustment of the joint or joints and before introducing them into the transfer machine.

This preheating not only has the effect of overcoming the longitudinal staggering of the design on either side of the joint but also of eliminating the opening-up of the joint and consequently eliminating the white line or fault in continuity in the design which appears at the position of the joint on the transfer-printed material. The preheating is carried out before or after the juxtaposition of the webs of transfer paper and before these webs are subjected to the register operation intended to adjust their relative position in such a way that the designs or pattern coincide on either side of the joint or joints. The preheating is preferably carried out until the shrinkage becomes negligible. In fact, the preheating temperature and its duration must be sufficient for the difference in shrinkage between the two webs forming a joint to be too low to produce an objectionable fault and for the joints no longer to change between the register station and the transfer station. However, this preheating must not cause the transfer of the dyestuffs. In the majority of cases the preheating conditions vary between 0.5 second and 2–5 minutes depending on the temperature, which must not exceed 160° C. In general, the process is carried out at between 90° and 150°, preferably at 100°–120° C.

This preheating can preferably be carried out in a heated chamber, for example by means of a stream of air, by infrared radiation or by microwaves. It is also possible to employ a flat or cylindrical heating surface.

This method gives results which are as good as those obtained if the wide width web has been produced by glueing the joints so as to overcome the shrinkages of the paper. It does not suffer from the disadvantages of glueing, in particular the difficulty of regulating the amount of glue applied, the difficulty of finding a glue or an adhesive tape which does not react with the print, changing its shade or its intensity, which does not transfer and which does not lose its efficiency when hot during the transfer, and the difficulty of finding an adhesive tape of which the coefficient of thermal expansion is close to that of the transfer paper webs.

The transfer paper webs which can be used in the process of the present invention are known. They generally have a standard width of 1.60 m. They can in particular carry a print based on disperse dyes which sublime or vaporise at between 160° and 250° C., optionally dyes which penetrate deeply into the printed substrate. That print is generally permeable to water vapor.

They optionally carry, on the face carrying the print or on the back of the latter, printed register marks or some other means of register appropriate to the device used, such as performance or magnetic register marks.

The transferable print itself may in certain cases be used as the register mark. Where this is not the case, it is obviously necessary to avoid any staggering between the repeats of the design and the positions of the register marks. The method of register, whether it is optical (with a visible register mark), magnetic, pneumatic or mechanical (with perforations) must preferably allow both lateral register and longitudinal register.

Thus, when printing transfer paper webs, a design which permits both lateral register and longitudinal register may be applied to their edges, for example a print consisting of rectangles which repeat along the web with a repeat distance corresponding to the pattern to be transferred, and of a continuous line parallel to the edges of the web. The designs which allow longitudinal register must be equidistant and the interval separating them must be equal to the repeat distance of the pattern to be transferred or to one of its sub-multiples.

The register marks can be printed by means of a supplementary engraved cylinder which can be of narrow width. In that case it can be applied to the underside of the web. It is also possible to engrave these register marks on one of the cylinders provided for printing the pattern to be transferred. In that case, the printing of the register marks is necessarily carried out with an ink containing a transferable substance and the edge of the web which carries this print must be cut off before transfer if it is at the right side of the wide width web made up in accordance with the present process.

Finally, in certain cases all or part of the print which is to be transferred may itself be utilised.

If the design to be transferred consists of lines respectively parallel or perpendicular to the edges of the webs, only lateral or longitudinal register, respectively, is necessary. If the lines are equidistant, the print itself can serve as a register print.

These register marks can be read by, for example, a photoelectric cell which is located facing each joint and functions continuously, or is only triggered when the register mark or the chosen design of the transferable print arrives opposite the cell.

The transfer paper webs can also carry, along their edges or over their entire surface, a film which is impermeable to the dyestuff vapours when it is heated to the transfer temperature. This film can be laid down between the transferable print and the paper base or on the underside of the latter. It can consist, for example, of gelatine, starch, an acrylic product or polyvinyl alcohol.

An installation which allows the present invention to be carried out comprises, for example, devices which allow the transfer paper webs to be unrolled (for example feed rollers) and devices which allow them to be tensioned (for example several pairs of tension rollers) whilst bringing them edge to edge in a drive device (for example a pair of rollers) which drives the webs at a constant speed and is provided with a tension control device. This installation also comprises, preferably between the tensioning devices and the drive device, devices for controlling the tension, and register devices. These latter make it possible to control the tension of the webs, for example by varying the speed of the pairs of tension rollers, as well as to move them laterally in accordance with the fluctuations of the register marks applied to these webs.

The present invention also relates to a transfer printing device which comprises devices which allow the transfer paper webs to be unrolled, devices which allow them to be tensioned whilst bringing them edge to edge in a drive device which drives the webs at a constant speed, devices which allow the tension of the transfer paper webs to be controlled and allow the webs to be moved laterally, and register devices which allow the tension of the webs, as well as their lateral movement, to be controlled in accordance with the fluctuations of the register marks appalied to these webs, and a transfer station, characterised in that the printing device also comprises a preheating station before the register devices and the transfer station.

On leaving the drive device, the webs are either edge to edge or overlap in a controlled manner, and the designs coincide on either side of the joint. In the second of the two cases, a device which cuts and removes the overlapping edges so as to produce a butt joint can be interposed between the drive device and the heating station. The parallel webs are exactly edge to edge or overlap but the design must continue uninterruptedly and without staggering on either side of the joint. In the case of an overlap, the width of the latter preferably does not exceed 2 mm.

The preheating station which is characteristic of the present invention can be, for example, either a chamber heated by a stream of air or possessing an infrared or microwave installation, or a set of heating plates or heating cylinders. The length of this station depends on the speed of travel of the transfer paper webs, on the temperature to which it is desired to preheat the webs, and on the time for which it is desired to subject them to this preheating. A preheating station which allows the printed paper to be brought to a temperature of at least 90° C. in a few seconds is necessary. It is located upstream from the station where the transfer takes place, that is to say upstream from the cylinder of the calender, and preferably upstream from the register device which adjusts the designs before the various webs enter the calender.

The wide width assembly of transfer paper webs then enters the transfer machine. The inlet of the latter is provided with a device for unwinding and driving the substrate to be printed. Means of driving and rewinding the printed substrate, and the used transfer paper webs, are similarly located at the outlet. The transfer is effected at atmospheric pressure, pressure being the same in either side of the substrate to be printed.

The devices can be modified or simplified. In particular, the cutting operation can be carried out before assembly by cutting one of the edges, for example before rewinding the initial web after it has been printed. If the design is in the form of longitudinal lines or stripes, lateral register suffices and the two edges of the web can thus be cut before assembly, but obviously after being brought into register.

Each of these devices is known to those skilled in the art and will therefore not be described in detail. (See, for example, the French Patent Application published under No. 2,316,080.)

EXAMPLE 1

The heat transfer printing calender of the figure possesses a heated chamber (1) located on the path of the 3 transfer paper webs (5) before these pass into the register device (4) and around the heated cylindrical drum (3).

The device (4) makes it possible to check the longitudinal and lateral position of the transfer paper webs and to actuate the correction devices (2). The latter are of the type of those described in French Patent Application No. 2,316,080 and can act on the speed of travel and move the paper transfer webs laterally. Such devices can also be mounted directly on the unwind rollers 9*a*, 9*b* and 9*c*. The transfer drum (3) has a diameter of 1.20 m.

The textile web (6) which is to be printed, for example a carpet, is tensioned around the drum (3), the transfer papers (5) being inserted between the web and the surface of the drum. Two pairs of guide-rollers (7) and (8), the axes of which are parallel to that of the drum, are located upstream and downstream from the drum (3) and are in contact with the underside of the textile web (6).

Downstream from the roller (8), the printed textile web (6) and the transfer papers are separated and guided separately to wind-up stations, particularly with the guide-roller (13).

The 3 transfer paper webs are unwound from three rollers 9*a*, 9*b* and 9*c* having axes parallel to the axis of the drum.

Of course the invention is not limited to the case where 3 transfer paper webs are used side by side, or to the case where the transfer calender does not employ an endless belt to tension the web to be printed, and the transfer paper, against the heated drum (3). Other types of calendar can be used, and any number of webs required by the width of the web (6) can be juxtaposed.

During unwinding, the 3 transfer paper webs are fed so as to overlap mutually by a few millimeters, in order to form a carrier (5) by juxtaposition.

The carrier (5) then passes through a heated chamber (1) and thereafter passes through the correction station (2) followed by the register station (4). The chamber (1) can also enclose the rollers *9a, 9b* and *9c*. Before entering the transfer calender, the patterns carried by two juxtaposed paper webs are in precisely superposed positions in the overlap zone. The selvedges are cut off at a width of 1.8 mm on either side of the joints.

The longitudinal coincidence between the patterns of 2 juxtaposed webs is brought about by varying the speed of travel of one of the webs, by braking one of the unwind rollers *9a, 9b* or *9c* if the corresponding web is in advance of the others. Good results are also obtained by not controlling the unwind rollers but using a drive device or braking device located between these unwind rollers and the inlet roller (7). For this purpose, photoelectric cells, for example, in the register station (4) read register marks which occur at intervals on one of the selvedges of the transfer paper webs.

A tension analyser is provided in the path of the transfer paper webs so that these webs are always at a tension within the range required for good functioning of the calender.

Other devices located in the register station (4) control the transverse position of the transfer paper webs and ensure the lateral coincidence of the pattern on either side of the joint. Another device (11), located downstream from this register station, cuts the selvedge (12) or at least those which are at the right side of the wide width web. This device consists of rotating knives mounted on an axe perpendicular to the direction of travel of the transfer paper webs. These devices are located facing each joint. The lateral register devices are coupled to means which allow the webs to be moved laterally. The transfer paper webs weigh 58 g/cm$^2$.

The air of the chamber (1) is heated to 115° C.–120° C. The transfer papers require 20 seconds to pass through this chamber. The contact time of the transfer paper/textile web combination on the transfer drum is 40 seconds. The unwind speed (and speed of printing) is of the order of 5.4 m/minute.

The transfer paper webs which have been used for transfer printing are wound up at the calender outlet around parallel but different axes so as to avoid abnormal tensions due to the overlap of the webs.

A 4.8 m wide textile web is thus obtained, which does not exhibit any fault in the areas which were opposite the joints. The impression continues from one edge to the other without obvious join.

Equally good results are obtained by using a slightly different cutting device which cuts the two selvedges without leaving any overlap in the area of the joints, thus producing butt joints.

I claim:

1. A wide width transfer printing process for printing with webs of material that undergo linear change upon thermal change wherein (a) at least two strips of transfer paper webs carrying transferable designs or patterns and register marks are pre-heated to 90°–150° C. and brought edge to edge, (b) adjusting the relative positions of these said transfer paper webs by means of the said register marks so that the designs or patterns coincide on either side of the joint or joints parallel to the strip edges, (c) introducing the so assembled transfer paper webs into a transfer machine where they are, still in register, brought into contact with the substrate to be printed and (d) heating the whole to between 160° and 250° C. for a time sufficient to effect the transfer of the said designs or patterns.

2. Process according to claim 1, characterised in that the transfer is effected to atmospheric pressure.

3. Process according to claim 1, characterised in that during transfer the pressure is the same on either side of the material to be printed.

4. Process according to claim 1, characterised in that the transfer paper webs are preheated by infrared radiation or by microwaves.

5. Process according to claim 1, characterised in that the transfer paper webs carry dyestuffs which are sublimable or vaporisable at between 160° and 250° C. under atmospheric pressure.

6. Process according to claim 1, characterised in that the transfer paper webs carry, on at least one of their edges, register marks which allow the position of the webs to be adjusted laterally and longitudinally.

7. Process according to claim 1, characterised in that the transfer paper webs carry a print which is permeable to water vapour.

8. Process according to claim 3, characterised in that transfer paper webs carrying sublimable or vaporisable dyestuffs which, at atmospheric pressure, penetrate deeply into the substrate to be printed, are preheated.

* * * * *